US006059608A

United States Patent [19]

Benes

[11] Patent Number: 6,059,608

[45] Date of Patent: May 9, 2000

[54] FILTERED ELECTRICAL CONNECTOR WITH TERMINAL TAIL ALIGNER

[75] Inventor: Kevin Benes, Willowbrook, Ill.

[73] Assignee: Molex Incorporated, Lisle, Ill.

[21] Appl. No.: 09/234,524

[22] Filed: Jan. 21, 1999

[51] Int. Cl.[7] ..... H01R 13/66

[52] U.S. Cl. ..... 439/620; 439/79

[58] Field of Search ..... 439/620, 79

[56] References Cited

U.S. PATENT DOCUMENTS 5,415,569 5/1995 Colleran et al. ..... 439/620

5,509,825 4/1996 Reider et al. ..... 439/620

5,551,893 9/1996 Johnson ..... 439/620

5,863,322 1/1999 Kinsey, Jr. et al. ..... 439/607

*Primary Examiner*—Gary F. Paumen

*Attorney, Agent, or Firm*—James C. Paschall

[57] ABSTRACT

A filtered electrical connector assembly includes a dielectric housing mounting a plurality of terminals which include tail portions projecting from the housing. A filter component is mounted over the tail portions against the housing. A tail aligner is engageable with the housing and includes a plurality of holes through which the tail portions of the terminals extend. The tail aligner includes an anti-vibration portion for engaging the filter component to prevent the filter component from vibrating relative to the connector housing.

20 Claims, 5 Drawing Sheets

FILTERED ELECTRICAL CONNECTOR WITH TERMINAL TAIL ALIGNER

FIELD OF THE INVENTION

This invention generally relates to the art of electrical connectors and, particularly, to a connector assembly which includes filtering means, such as a ferrite block, along with terminal alignment means to facilitate mounting the filtering means.

BACKGROUND OF THE INVENTION

Electrical circuitry often is used in environments wherein the circuitry must be protected from disruptions or "noise" caused by electromagnetic interference (EMI), radio frequency interference (RFI), electrostatic discharges (ESD) and/or electromagnetic pulses (EMP). Such applications may range from use in high frequency pulse circuits, such as computers, wherein signals are generated which will cause radio frequency interference and electromagnetic interference to nearby radio and other electronic devices, to automotive applications wherein equipment must be protected against power surges owing to electrostatic discharges and electromagnetic pulses as well. A high voltage generated by electrostatic discharges and electromagnetic pulses can damage voltage sensitive integrated circuits and the like.

One environment wherein such problems have become prevalent is in the automotive industry wherein electronics, including computer circuitry, have become common to control, monitor or otherwise interconnect all kinds of electrical circuitry within the operative systems of the vehicle. Such connectors are utilized "under the hood" of an automobile or other vehicle which employs a multitude of electrical interconnections.

In environments as described above, it is desirable to provide the connector assembly with a filtering capability, such as to suppress EMI and RFI, and transient suppression means to suppress EMP and ESD interference or other undesirable signals which may exist in circuits terminated to the connectors. Employing filter components in a connector assembly creates problems in manufacture and assembly because of the undue complexity of the connectors, particularly in substantially increasing the assembly costs of the connectors. In the extremely high volume environment of automotive applications, cost considerations can be extremely important. In addition, considerable problems have been encountered in certain environments, such as automotive applications, which involve vibrations of the connector. When employing filtering means, such as ferrite blocks, the vibrations tend to "rattle" the filtering components which result in damage to the connector.

In high density connectors, still additional considerations must be addressed in aligning the terminals at a proper spacing or "pitch" and to protect pin or tail portions of the connector terminals during manufacture, assembly and/or use. This is particularly true when the connector assembly is mounted to a printed circuit board. Alignment components add still further complexity and cost to the connectors.

The present invention is directed to solving this myriad of problems in a unique system whereby a tail aligning means is used to stabilize a filtering means.

SUMMARY OF THE INVENTION

An object, therefore, of the invention is to provide a new and improved filtered electrical connector assembly of the character described.

Another object of the invention is to provide a filtered electrical connector assembly wherein a tail aligner is used to prevent vibration of a filter component.

In the exemplary embodiment of the invention, the connector assembly includes a dielectric housing having a plurality of terminal-receiving passages. A plurality of terminals are received in the passages and include tail portions projecting from the housing. A filter component is disposed adjacent the housing and has at least one hole through which the tail portion of at least one of the terminals extend. A tail aligner is engageable with the housing and includes a plurality of holes through which the tail portions of the terminals extend. Complementary interengaging anti-vibration means are provided between the tail aligner and the filter component to prevent the filter component from vibrating relative to the connector housing.

As disclosed herein, the filter component comprises a ferrite block. In one embodiment of the invention, the anti-vibration means include a wedge means on the tail aligner engageable with the ferrite block. The tail aligner preferably is fabricated of molded plastic material, and the wedge means may be provided by an integral wedge-shaped portion of the tail aligner.

In another embodiment of the invention, the anti-vibration means includes a flexible spring beam engageable with the ferrite block. With the tail aligner molded of plastic material, the flexible spring beam may be an integral portion of the tail aligner.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
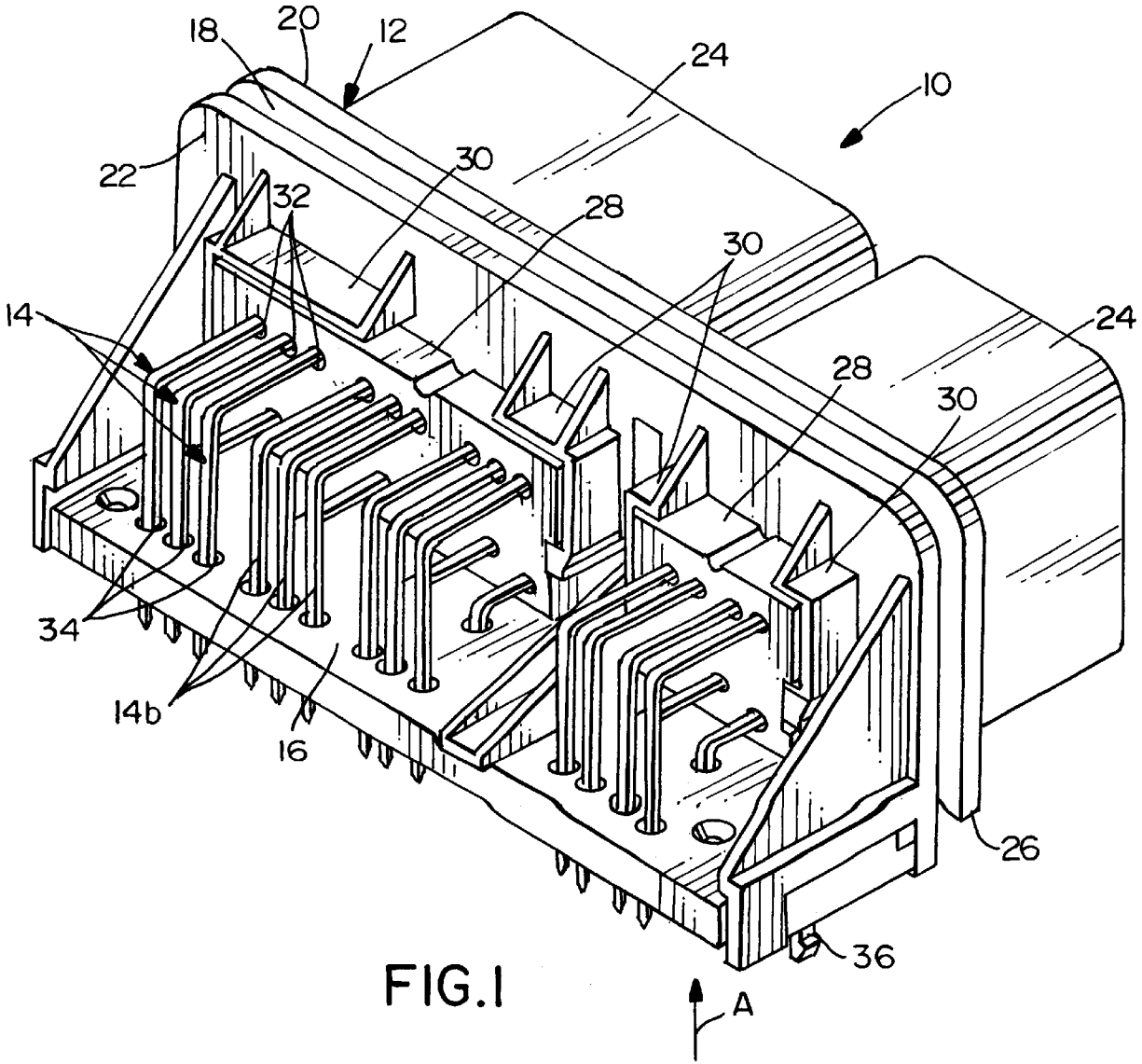
FIG. 1 is a rear perspective view of an electrical connector assembly embodying the concepts of the invention.
Figure 2:
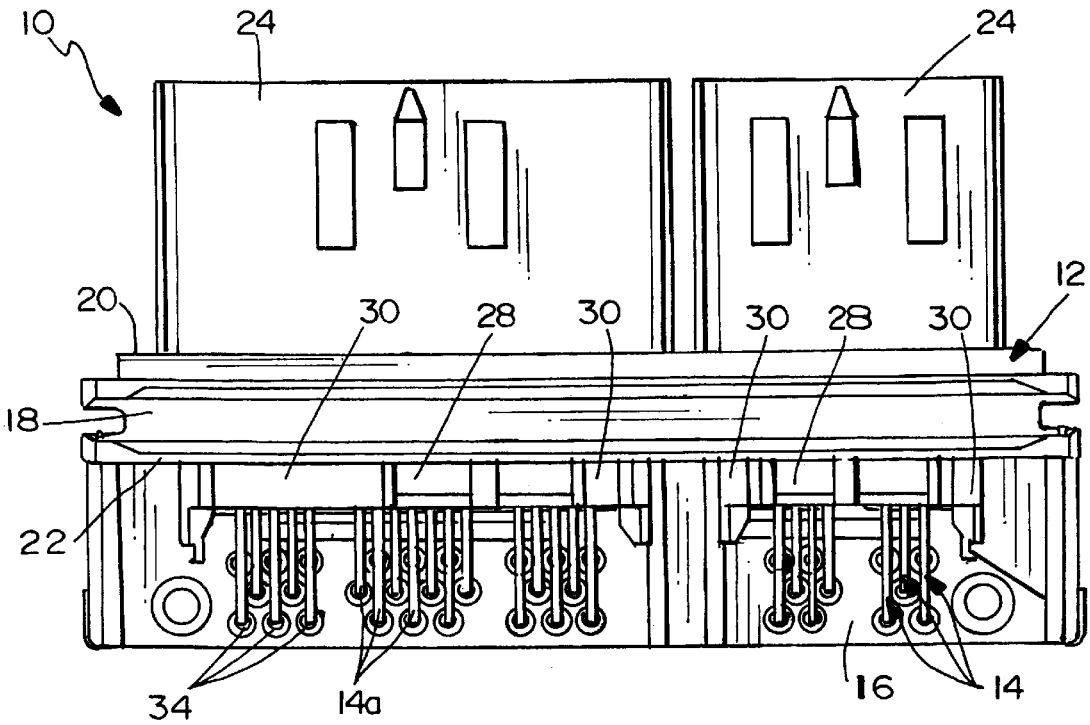
FIG. 2 is a top plan view of the connector assembly.
Figure 3:
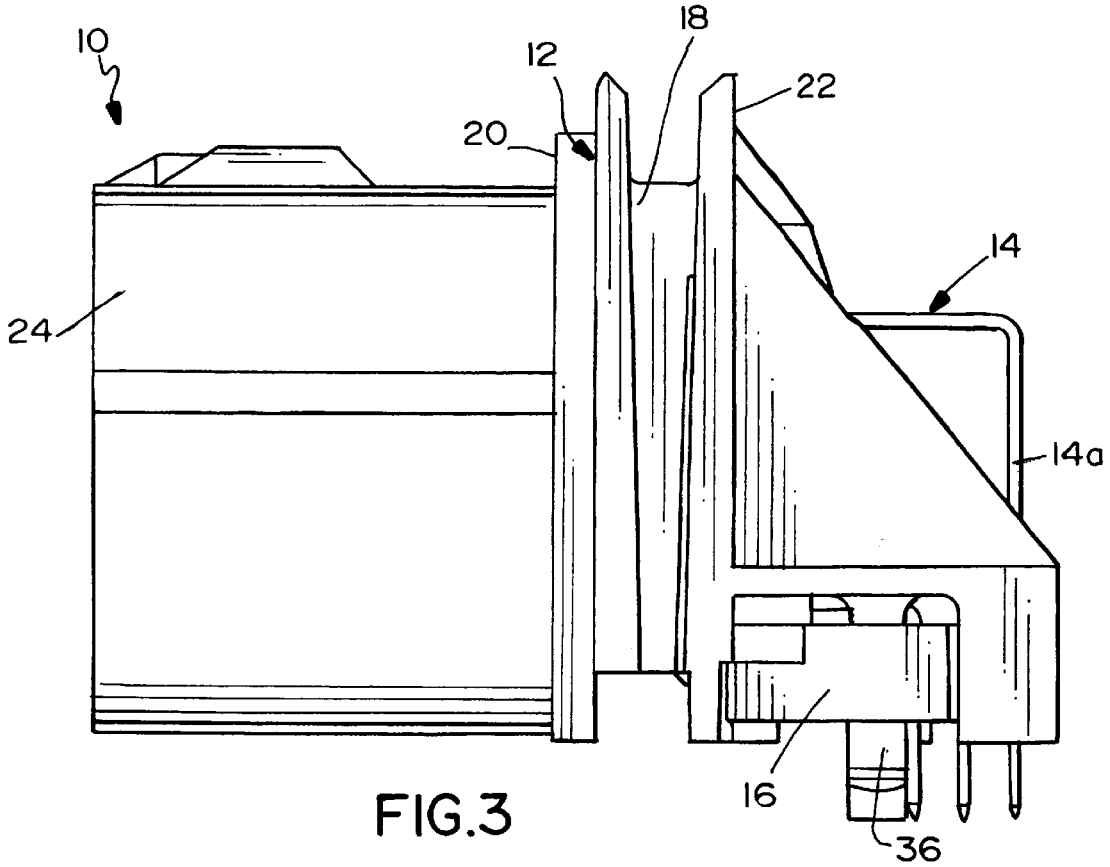
FIG. 3 is a side elevational view of the connector assembly.

Referring to the drawings in greater detail, and first to FIGS. 1–3, the invention is embodied in an electrical connector assembly, generally designated 10, which is adapted for mounting on a printed circuit board. Generally, the connector includes an elongated dielectric housing, generally designated 12, for mounting a plurality of conductive terminals, generally designated 14, along with a tail aligner 16 mounted on the housing for properly aligning and spacing tail portions 14*a* of the terminals.

More particularly, elongated dielectric housing 12 includes a body portion 18 defining a front mating face 20 and a rear face 22. The housing is unitarily molded of plastic material or the like and includes one or more mating receptacles 24 which project forwardly of mating face 20. Actually, the receptacles receive and mate with plug portions of one or more mating connectors (not shown). Finally, the housing has a bottom face 26 for mounting on a surface of a printed circuit board (not shown).

Terminals 14 are mounted in body portion 18 of housing 12 in three rows. Each terminal includes a forward contact portion (not visible in the drawings) projecting from the body portion of the housing into one of the mating receptacles 24 of the connector. Each terminal includes a right-angled tail portion 14*a* projecting rearwardly of the body portion beyond rear face 22 and then downwardly for insertion into appropriate holes in the printed circuit board. The end portions of the terminals are soldered to appropriate circuit traces on the board and/or in the holes. The tail portions of the top row of terminals are longer than the tail portions of the middle row of terminals which, in turn, are longer than the bottom row of terminals, so that the ends of the tail portions of the terminals are inserted into three rows of holes in the printed circuit board.

As seen in FIGS. 1 and 2, a pair of filters 28 are installed over tail portions 14*b* of terminal 14. These filters are provided in the form of ferrite blocks. Housing 12 has a plurality of angle brackets 30 projecting rearwardly of rear face 22 to define positioning means for mounting the ferrite blocks against rear face 22 of the housing. In assembling the ferrite blocks to the connector, tail portions 14*a* are in a straight-line configuration projecting from the rear face of the housing. The ferrite blocks include a plurality of holes 32 through which the tail portions of the terminals are inserted. After the ferrite blocks are mounted over the tail portions, the tail portions are formed into their right-angled configurations as shown clearly in FIG. 1.

Tail aligner 16 includes a plurality of holes 34 through which the tail portions of the terminals extend. The tail aligner is assembled over the tail portions in the direction of arrow "A" (FIG. 1). The tail aligner is mounted over a pair of mounting posts 36 molded integrally with the housing to fix the tail aligner to the housing. From the foregoing, it can be understood that holes 34 in the tail aligner provide means for properly spacing and aligning the end portions of terminal tails 14*a* in directions generally parallel to the printed circuit board to which the connector is mounted, so that the tips of the tail portions can be easily inserted into their respective holes in the printed circuit board.

As stated in the "Background", above, one of the problems with using filter components, such as ferrite blocks 28, in environments wherein connector 10 is subject to vibrations, is that the filter components or ferrite blocks tend to vibrate, "rattle", move relative to the tail portions and eventually damage the terminals and/or the connector housing. Generally, the present invention is directed to solving these problems in a unique system whereby tail aligner 16 is used to perform a dual function as an anti-vibration means to prevent the ferrite blocks from vibrating.

Figure 4:
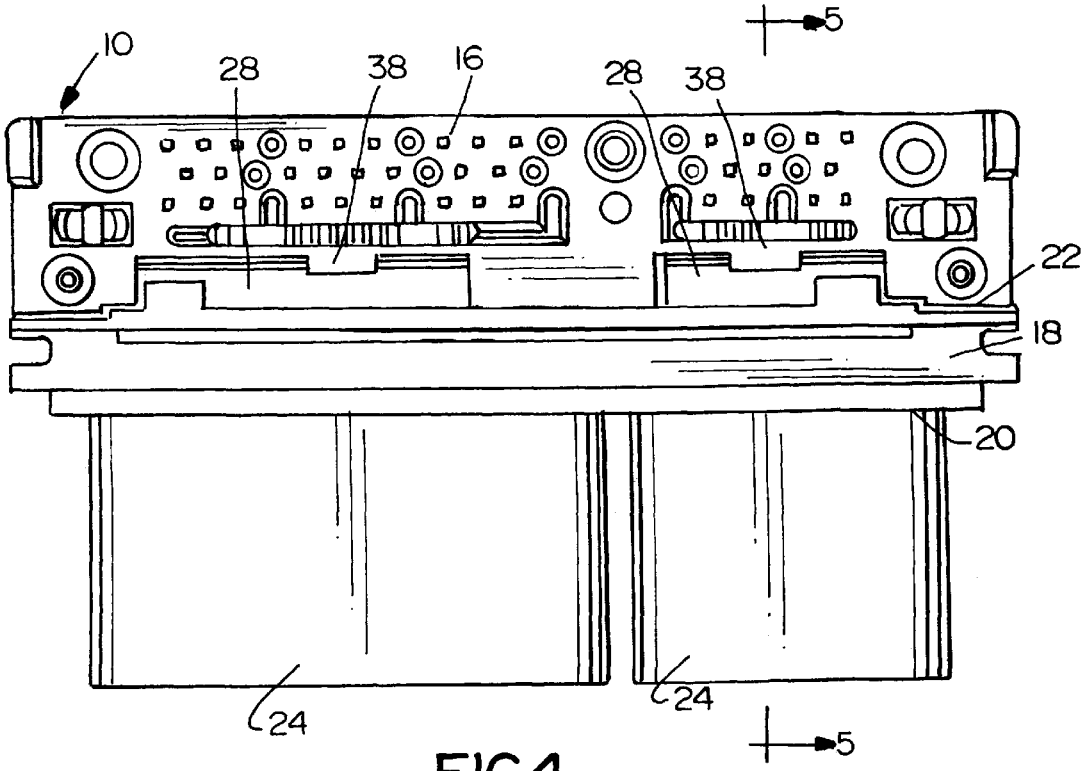
FIG. 4 is a bottom plan view of the connector assembly, showing one embodiment of the anti-vibration means.
Figure 5:
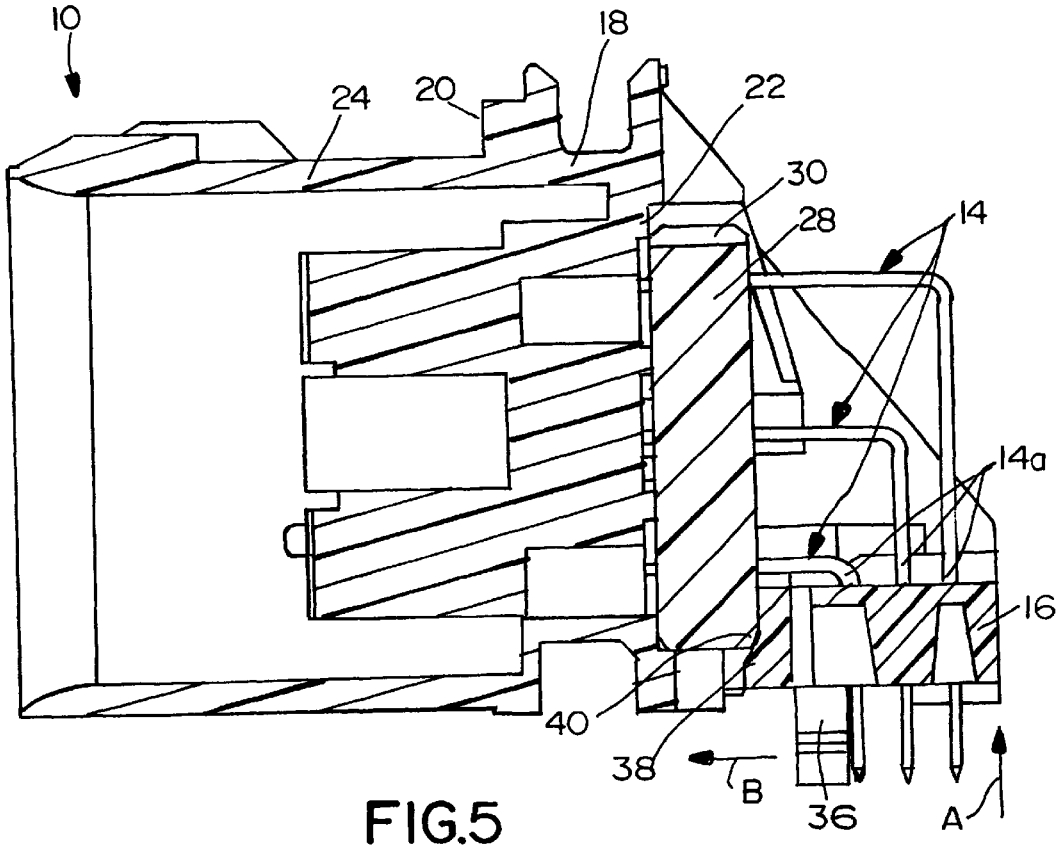
FIG. 5 is an enlarged section taken generally along line 5—5 of FIG. 4.

More particularly, referring to FIGS. 4 and 5 in conjunction with FIG. 1, a first embodiment of anti-vibration means comprise a pair of wedges 38 on tail aligner 16 for engaging the pair of ferrite blocks 28 as best seen in FIG. 5. If tail aligner 16 is fabricated of molded plastic material, the wedges can easily be formed integrally with the tail aligner. In essence, the wedges present angled surfaces which engage ferrite blocks 28 at points 40 shown in FIG. 5. Therefore, when tail aligner 16 is positioned onto tail portions 14*a* of terminals 14 and fixed to the housing in the direction of arrow "A", the wedges or angled surfaces 38 create force vectors in both the vertical ("A") and horizontal ("B") directions to force the ferrite blocks upwardly against the top angle brackets 30 and horizontally against rear face 22 of the housing. The ferrite blocks are biased or "jammed" into tight anti-vibration positions.

Figure 6:
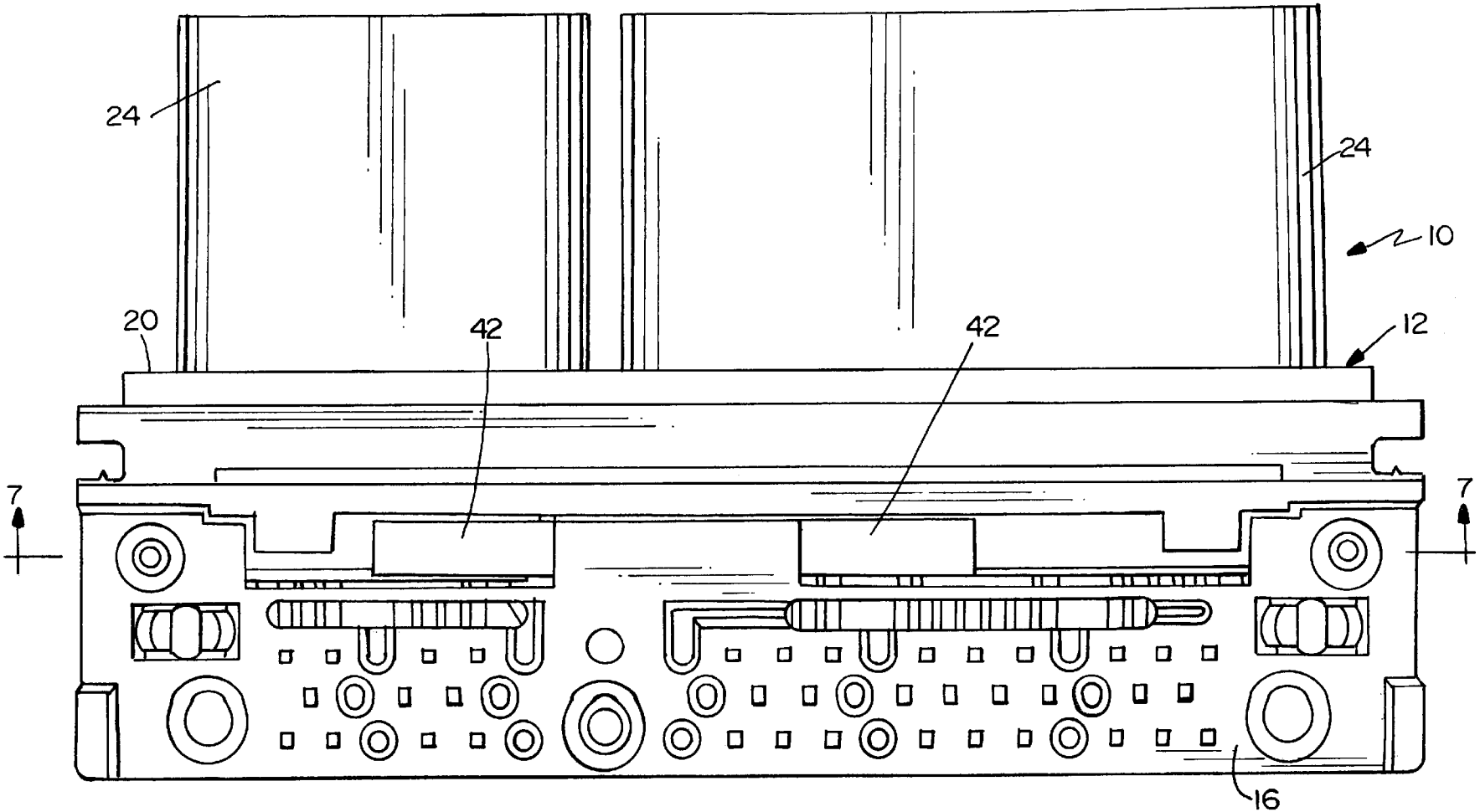
FIG. 6 is a bottom plan view of the connector assembly, showing an alternate embodiment of the anti-vibration means.
Figure 7:
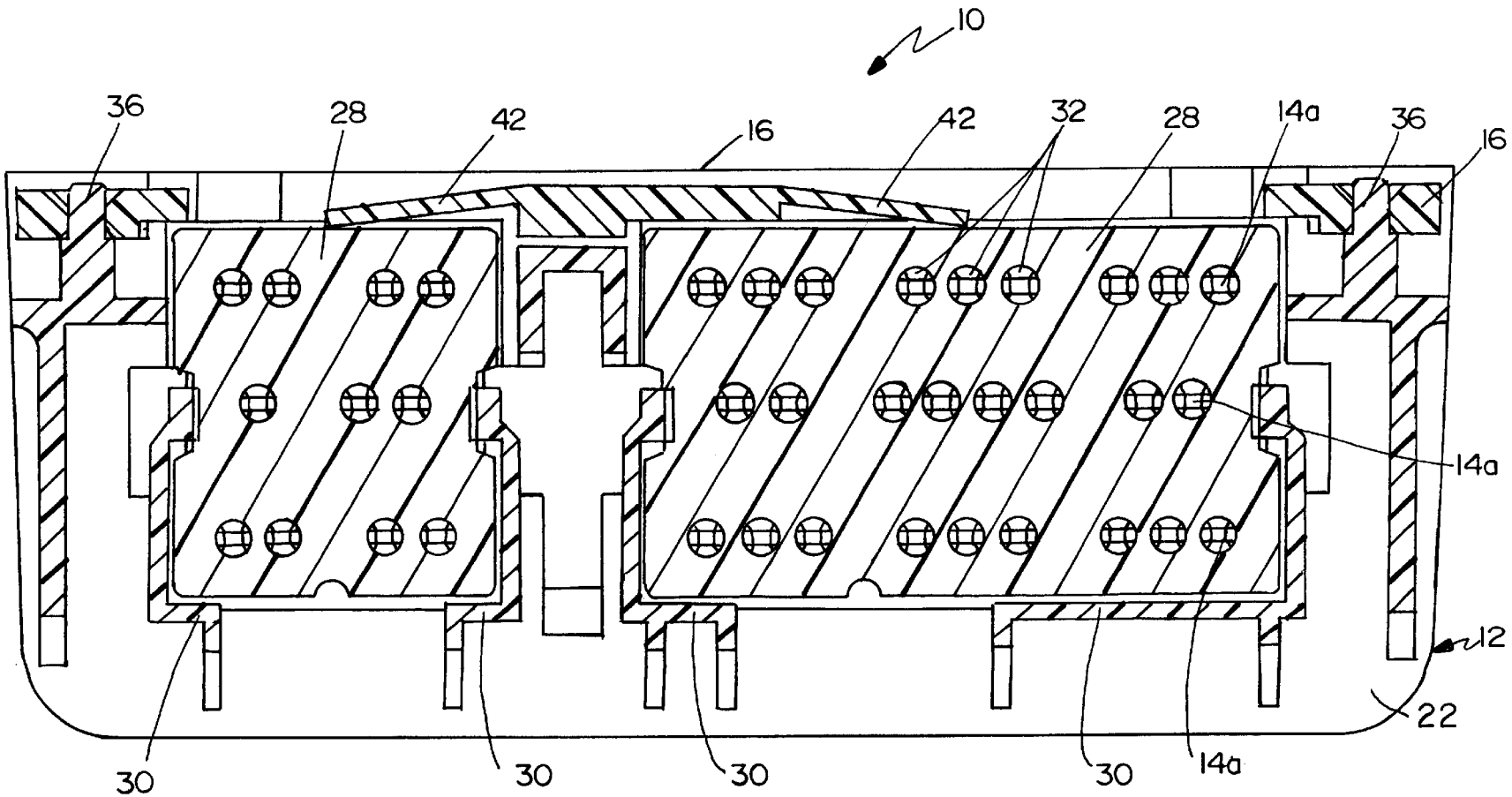
FIG. 7 is a section taken generally along line 7—7 of FIG. 6.

FIGS. 6 and 7 show a second embodiment of the invention wherein the anti-vibration means are provided by a pair of flexible spring beams 42 molded integrally with the tail aligner. These beams can apply considerable forces to bias ferrite blocks 28 upwardly against angle brackets 30 so that the ferrite blocks do not vibrate relative to the connector housing and the terminal tails on which the ferrite blocks are mounted.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A filtered electrical connector assembly for mounting on a printed circuit board, comprising:

a dielectric housing having a body portion with a front mating face and a rear face;

a plurality of terminals mounted on the housing and including tail portions projecting from the body portion beyond said rear face thereof;

a filter component having an least a portion thereof in direct engagement with the rear face of the housing and having a plurality of holes through which the tail portions of the terminals extend;

a tail aligner engageable with the housing and including a plurality of holes through which the tail portions of the terminals extend; and complementary interengaging anti-vibration means between the tail aligner and filter component to prevent the filter component from vibrating relative to the connector housing.

2. The filtered electrical connector of claim 1 wherein said anti-vibration means include a wedge means on the tail aligner engageable with the filter component.

3. The filtered electrical connector of claim 2 wherein said tail aligner is fabricated of molded plastic material, and said wedge means comprises an integral wedge-shaped portion of the tail aligner.

4. The filtered electrical connector of claim 3, including a plurality of said wedge shaped portions spaced laterally of the tail aligner.

5. The filtered electrical connector of claim 1 wherein said filter component comprises a ferrite block.

6. The filtered electrical connector of claim 1 wherein said anti-vibration means includes a flexible spring beam engageable with the filter component.

7. The filtered electrical connector of claim 6 wherein said tail aligner is fabricated of molded plastic material, and said flexible spring beam comprises an integral portion of the tail aligner.

8. The filtered electrical connector of claim 7, including a plurality of said flexible spring beams on the tail aligner.

9. A filtered electrical connector assembly, comprising:

a dielectric housing mounting a plurality of terminals which include tail portions projecting from the housing;

a filter component having an least a portion thereof in direct engagement with the housing and having at least one hole through which the tail portion of one of the terminals extend;

a tail aligner engageable with the housing and including a plurality of holes through which the tail portions of the terminals extend; and complementary interengaging anti-vibration means between the tail aligner and the filter component to prevent the filter component from vibrating relative to the connector housing.

10. The filtered electrical connector of claim 9 wherein said anti-vibration means include a wedge means on the tail aligner engageable with the filter component.

11. The filtered electrical connector of claim 10 wherein said tail aligner is fabricated of molded plastic material, and said wedge means comprises an integral wedge-shaped portion of the tail aligner.

12. The filtered electrical connector of claim 11, including a plurality of said wedge shaped portions spaced laterally of the tail aligner.

13. The filtered electrical connector of claim 9 wherein said filter component comprises a ferrite block.

14. The filtered electrical connector of claim 9 wherein said anti-vibration means includes a flexible spring beam engageable with the filter component.

15. The filtered electrical connector of claim 14 wherein said tail aligner is fabricated of molded plastic material, and said flexible spring beam comprises an integral portion of the tail aligner.

16. The filtered electrical connector of claim 15, including a plurality of said flexible spring beams on the tail aligner.

17. A filtered electrical connector assembly, comprising:

a dielectric housing mounting a plurality of terminals which include tail portions projecting from the housing;

a filter component having an least a portion thereof in direct engagement with the housing and having at least one hole through which the tail portion of one of the terminals extend;

a tail aligner engageable with the housing and including a plurality of holes through which the tail portions of the terminals extend; and a complementary interengaging anti-vibration wedge on the tail aligner engageable with the filter component to prevent the filter component from vibrating relative to the connector housing.

18. The filtered electrical connector of claim 17 wherein said tail aligner is fabricated of molded plastic material, and said wedge comprises an integral wedge-shaped portion of the tail aligner.

19. The filtered electrical connector of claim 18, including a plurality of said wedge shaped portions spaced laterally of the tail aligner.

20. The filtered electrical connector of claim 17 wherein said filter component comprises a ferrite block.

* * * * *